US005707034A

United States Patent [19]

Cotterill

[11] Patent Number: 5,707,034

[45] Date of Patent: Jan. 13, 1998

[54] LINKAGE SYSTEM

[76] Inventor: Michael John Cotterill, Lot 5, Tugalong Road, Canyonleigh, N.S.W. 2577, Australia

[21] Appl. No.: 492,024

[22] PCT Filed: Dec. 23, 1993

[86] PCT No.: PCT/AU93/00680

§ 371 Date: Jun. 29, 1995

§ 102(e) Date: Jun. 29, 1995

[87] PCT Pub. No.: WO94/15499

PCT Pub. Date: Jul. 21, 1994

[30] Foreign Application Priority Data

Dec. 30, 1992 [AU] Australia ..... PL 6602
May 21, 1993 [AU] Australia ..... PL 8873

[51] Int. Cl.[6] ..... E04G 3/00; A47B 88/00; A47B 21/02

[52] U.S. Cl. ..... 248/284.1; 248/281.1; 248/286; 312/282; 108/5

[58] Field of Search ..... 248/276.1, 284.1, 248/286.1, 291.1, 292.12, 292.14, 299.1, 918; 74/99 A, 102

[56] References Cited

U.S. PATENT DOCUMENTS

| | | | |
|---|---|---|---|
| 326,511 | 9/1885 | McConnell | 74/102 X |
| 2,707,128 | 4/1955 | Greenfield | 248/284.1 X |
| 2,734,708 | 2/1956 | Cohn | 248/299.1 X |
| 2,738,987 | 3/1956 | McDonald | 248/292.14 X |
| 4,145,097 | 3/1979 | Naess et al. | 248/918 X |
| 4,368,866 | 1/1983 | Urban | 248/286 |
| 4,379,429 | 4/1983 | Gubbe et al. | 248/918 X |
| 4,706,919 | 11/1987 | Soberalski et al. | 248/281.1 |
| 5,098,053 | 3/1992 | Cotterill | 248/281.1 |
| 5,302,015 | 4/1994 | Du Vall | 248/286.1 X |

FOREIGN PATENT DOCUMENTS

| | | | |
|---|---|---|---|
| A-46294/85 | 3/1986 | Australia . | |
| A-65578/90 | 5/1991 | Australia . | |
| 112676 | 4/1968 | Norway | 248/284.1 |

*Primary Examiner*—Leslie A. Braun
*Assistant Examiner*—Charles J. Hunter
*Attorney, Agent, or Firm*—Pearne, Gordon, McCoy & Granger LLP

[57] ABSTRACT

A linkage system (1) for connecting a first element (2) and a second element (3) includes a linkage arm (4) respectively connected at a first end and a second end (5, 6) respectively to the first and second elements. Arm (4) includes at end (5) two spaced apart engagement formations, pin (7) and pin (8). These pins slidably inter-engage on the first element a guide slot (9) and a control slot (10) respectively. Relative movement between pins (7, 8) and the guide and control slot (9, 10) respectively provides predetermined non-arcuate relative movement between elements (2, 3).

17 Claims, 8 Drawing Sheets

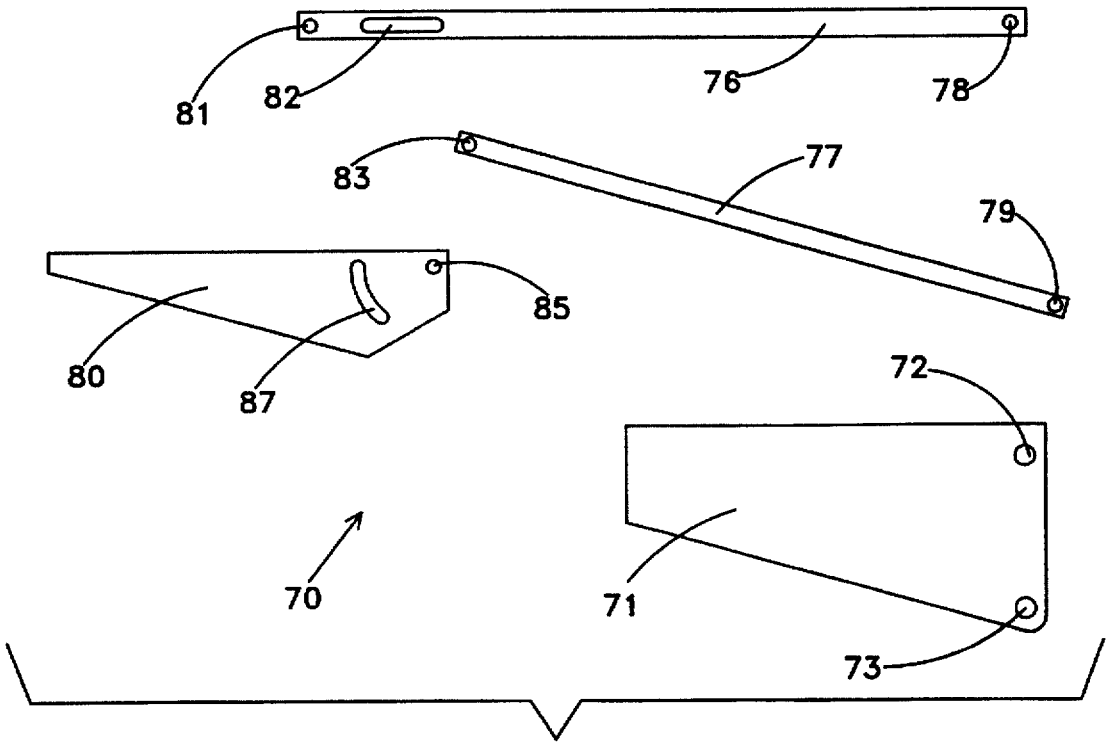
Fig. 10
Fig. 11
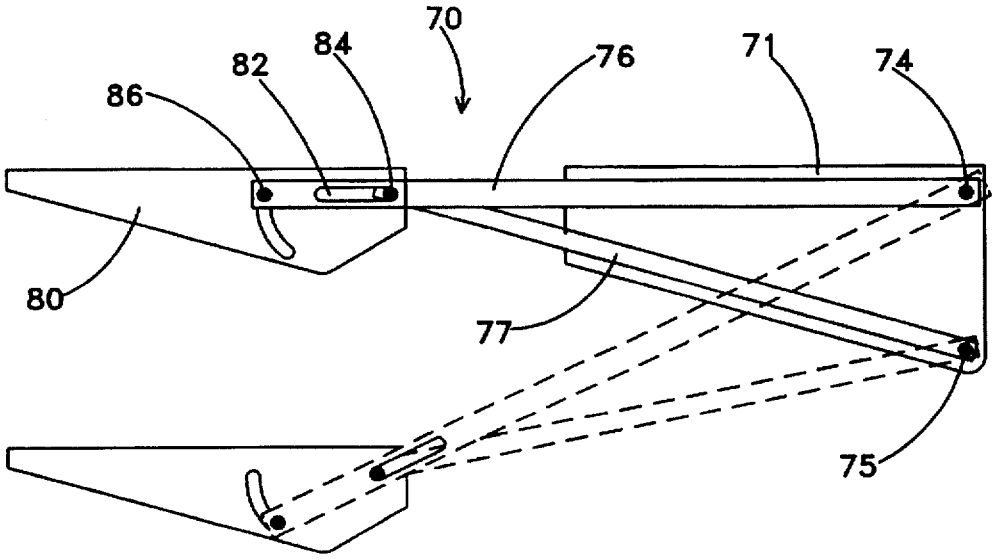

LINKAGE SYSTEM

TECHNICAL FIELD

The present invention relates to a linkage system.

The invention has been developed primarily for use with adjustable furniture and in particular height adjustable desks and will be described hereinafter with reference to that application. However, it will be appreciated that the invention is not limited to that particular field of use.

BACKGROUND ART

Hitherto, height adjustment mechanisms for desks have included a single linkage arm which extends between and is rotatably connected to both a fixed support and a movable support. Although movement of the movable support between a raised and lowered configuration is accommodated, that movement is limited to rotation through an arc having an axis passing through the connection point between the arm and the fixed support. Additionally, a single arm is often subject to large twisting moments which results in wear and requires that the arm be produced from heavy gauge materials.

Alternative prior art systems utilise a pantographic mechanism which, while providing greater effective strength, is generally of increased cost and complexity. Moreover, the path followed by the movable support is still substantially arcuate.

Accordingly, hereinafter the term arcuate movement will be taken to include movement that results from the prior art single linkage and pantographic linkage mechanisms.

An additional problem of the prior art resides in the fact that effective strength of the pantographic mechanism is dependant upon the distance between the two arms. Although an increase in this distance will provide an increase in the strength, it also results in a much larger, and at times cumbersome, mechanism. This is particularly disadvantageous for adjustable desks were a larger mechanism causes a reduction in leg room beneath the movable surface.

DISCLOSURE OF THE INVENTION

It is an object of the present invention, at least in a preferred embodiment, to overcome or substantially ameliorate at least some of these deficiencies of the prior art. According to the invention there is provided a linkage system for connecting a first element having a guide formation and a control formation and a second element, the system including a linkage arm respectively connected at a first end and a second end to the first and second elements, the arm including at the first end two spaced apart engagement formations for slidably inter-engaging the guide formation and the control formation respectively, whereby relative movement between the first and second formations and the guide and control formations respectively provides for predetermined non-arcuate relative movement between the first and second elements.

Preferably, the engagement formations are hinge pins and the guide and control formations are both slots in the first element for respectively receiving the pins. More preferably, one of the slots includes locking formations for selectively engaging a respective pin for maintaining the first and second elements in one of a number of relative dispositions. Even more preferably, the first element comprises a fixed support bracket for attachment to a desk surface and the second element comprises a keyboard support bracket for attachment to a keyboard support, whereby, in use, said keyboard support is movable between a raised and lowered configuration with respect to the desk. However, in alternative embodiments the first and second elements comprise the keyboard support bracket and the fixed. support bracket respectively.

Preferably also, the linkage system includes a support arm extending between the first and second elements. More preferably, the support arm is rotatably connected at respective ends to the first and second elements. Even more preferably, the support arm is hingedly and slidably connected at one end to one of the first and second elements.

In a preferred form, the connections of the linkage and guide arms to at least one of the first and second elements are spaced apart. More preferably, the spacing between the connections of the linkage and guide arms to the first element is greater than the spacing between the connections of those arms to the second element.

BRIEF DESCRIPTION OF THE DRAWINGS

A number of preferred embodiments of the invention will now be described, by way of example only, with reference to the accompanying drawings in which:

FIG. 10 is an exploded side view of a further alternative embodiment of a linkage system according to the invention; and FIG. 11 is a side view of the linkage system of FIG. 10 when assembled.

MODES FOR CARRYING OUT THE INVENTION

Figure 2:
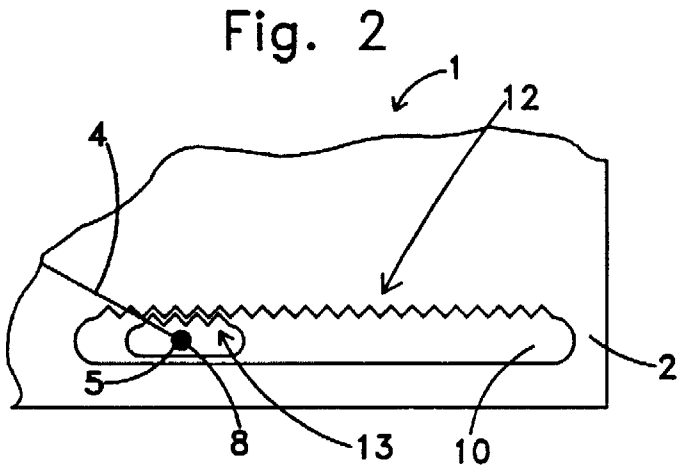
FIG. 2 is a fragmented view of the linkage system of FIG. 1 illustrating alternative locking means.
Figure 1:
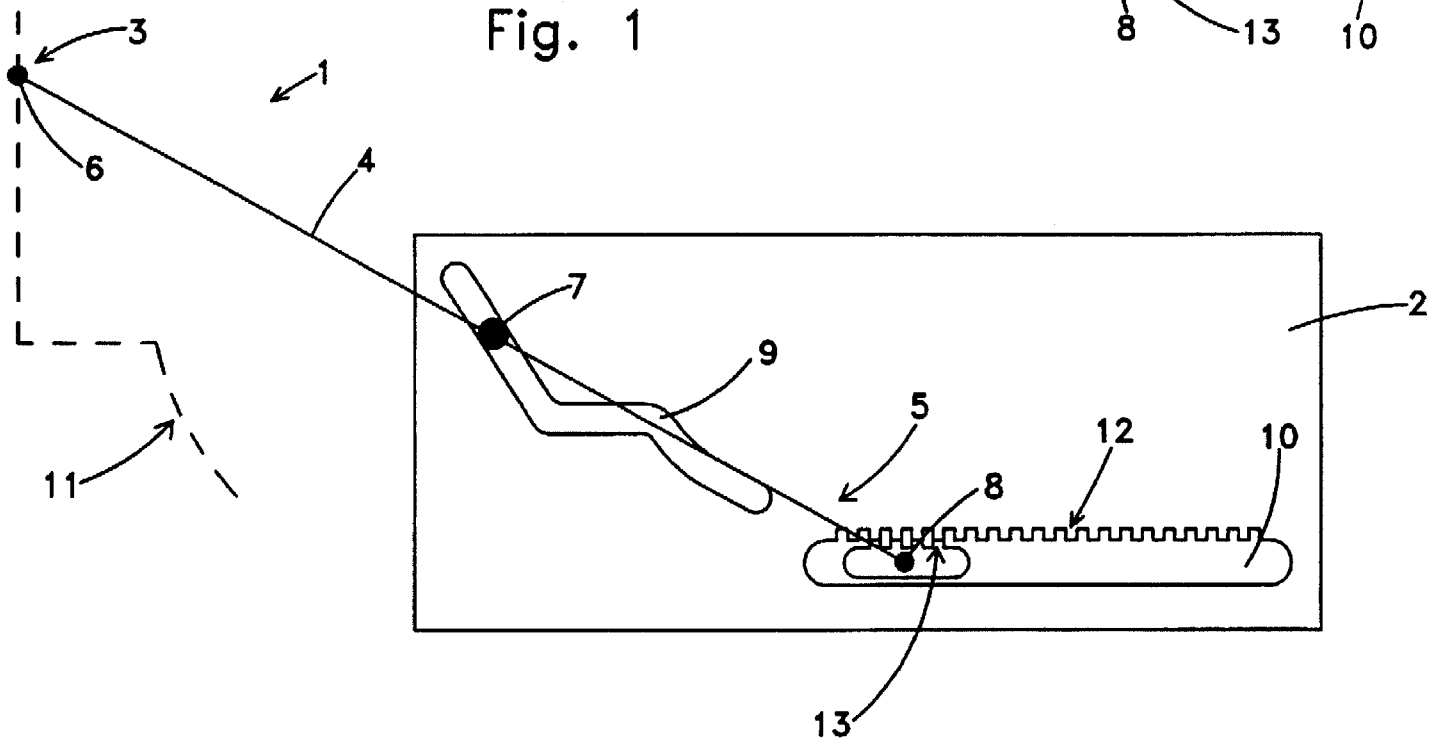
FIG. 1 is a schematic side view of a linkage system in accordance with the invention.

Referring to the drawings, and particularly to FIGS. 1 and 2, a linkage system 1 for connecting a first element 2 and a second element 3 includes a linkage arm 4 respectively connected at a first and a second end 5 and 6 respectively to the first and second elements. Arm 4 includes at end 5 two spaced apart engagement formations, pin 7 and pin 8. These pins slidably inter-engage on the first element a guide slot 9 and a control slot 10 respectively. Relative movement between pins 7 and 8 and the guide and control slot 9 and 10 respectively provides predetermined non-arcuate relative movement between elements 2 and 3.

In this particular embodiment element 2 is configured for abutment on the undersurface of a desk while end 6 of arm 4 is attached to a keyboard support (not shown). The keyboard support is moved along a predetermined non-arcuate path designated by broken line 11 as end 3 moves between its extremes of travel. Path 11 is defined by the interaction of the pins in the control and guide slots. As will be appreciated by those skilled in the art the slots can be varied in shape to suite a particular application.

In FIG. 1 the locking mechanism is formed by an array of teeth 12 along the top edge of slot 10 and a complimentary smaller array of teeth 13 along adjacent top edge of pin 8. These teeth are shown in the disengaged configuration to allow pins 7 and 8 to translate along slots 9 and 10.

In use, end 6 of arm 4 will be biased downwardly due to the presence of the keyboard support and/or a keyboard. Accordingly, the teeth 12 and 13 will be biased into a locked configuration. To effect height adjustment the keyboard support is lifted or tilted upward to overcome the gravitational bias and subsequently by applying a force to arm 4 which causes the translation of the pins 7 and 8 in the slots 9 and 10 respectively. Upon reaching a desired position the keyboard support can be released and the gravitational bias will again move teeth 12 and 13 into locking interengagement.

FIG. 2 illustrates an alternative embodiment of the invention where corresponding features are designated with corresponding reference numerals. This linkage system is substantially the same as that disclosed in FIG. 1 with the exception that the teeth 12 and 13 are triangular in nature to facilitate movement into a locked configuration. Other embodiments include a ratchet style of locking arrangement to facilitate upward movement of the keyboard support while requiring the teeth to be fully moved out of a locked configuration before downward movement can be achieved.

Figure 3:
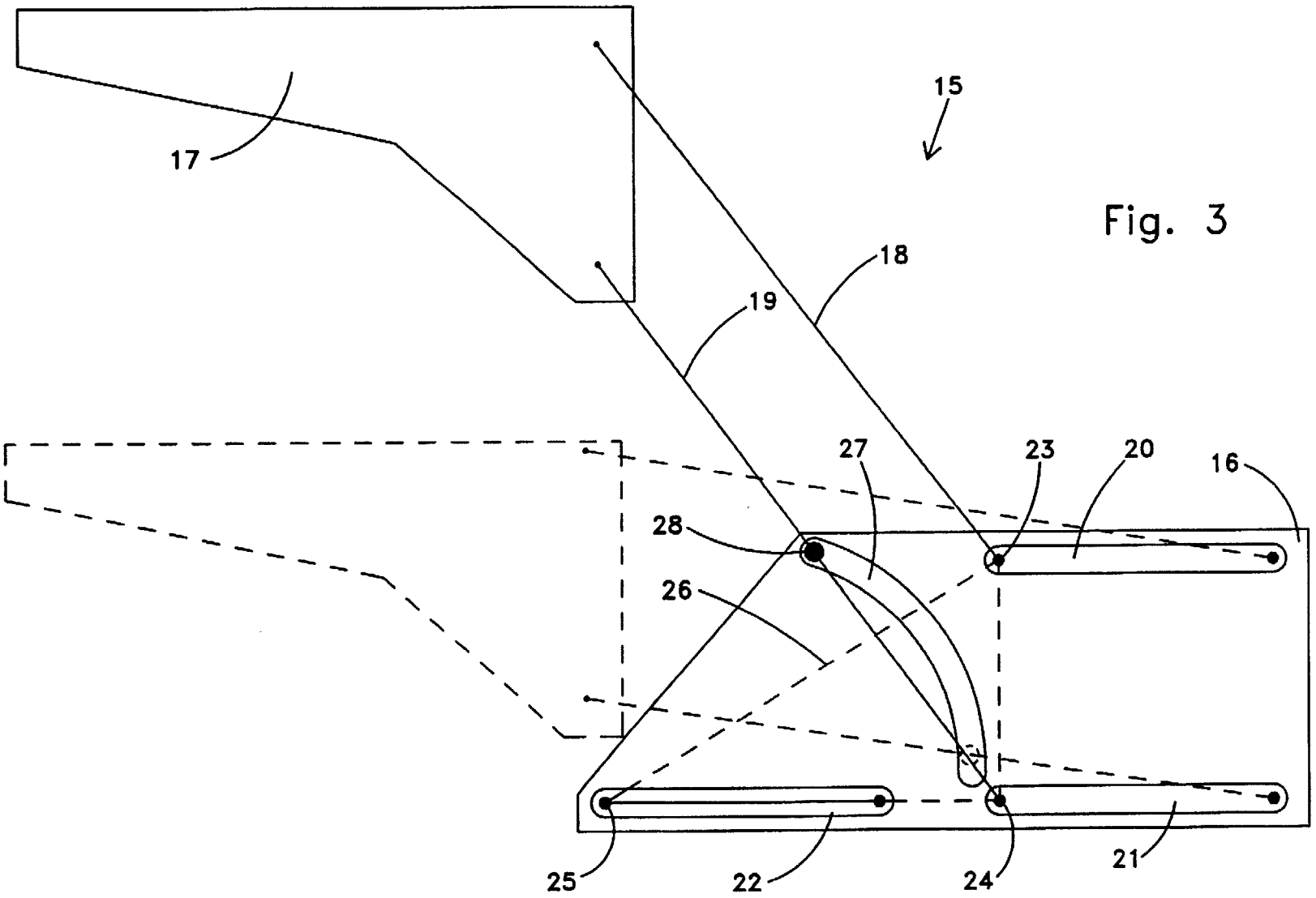
FIG. 3 is alternative embodiment of a linkage system according to the invention.

Turning now to FIG. 3 an alternative embodiment of the invention is shown. Linkage system 15 includes a fixed support bracket 16 for mounting to a desk or the like and a keyboard support bracket 17 which is mounted to bracket 16 by way of linkage arms 18 and 19.

Bracket 16 includes three parallel slots 20, 21 and 22 for slidably receiving pins 23, 24 and 25 respectively. These pins are joined by way of a triangular frame 26 to ensure simultaneous progression of the pins along the slots. Bracket 16 also includes a guide slot 27 which slidably receives a pin 28 which is intermediately located along arm 19.

This slot configuration enables keyboard support bracket 17 to move in a substantially vertical direction upon horizontal translation of frame 26. Again, this translation is effected by the interaction between the guide and control slots and is substantially a linear translation.

If required, the movement of the keyboard support bracket between the raised and lowered configurations can be assisted by way of biasing means or, for example, a pneumatic cylinder extending between frame 26 and bracket 16. In addition, locking means can be included to selectively retain the frame at one of a number of dispositions to subsequently maintain bracket 17 at a particular height.

Figure 4:
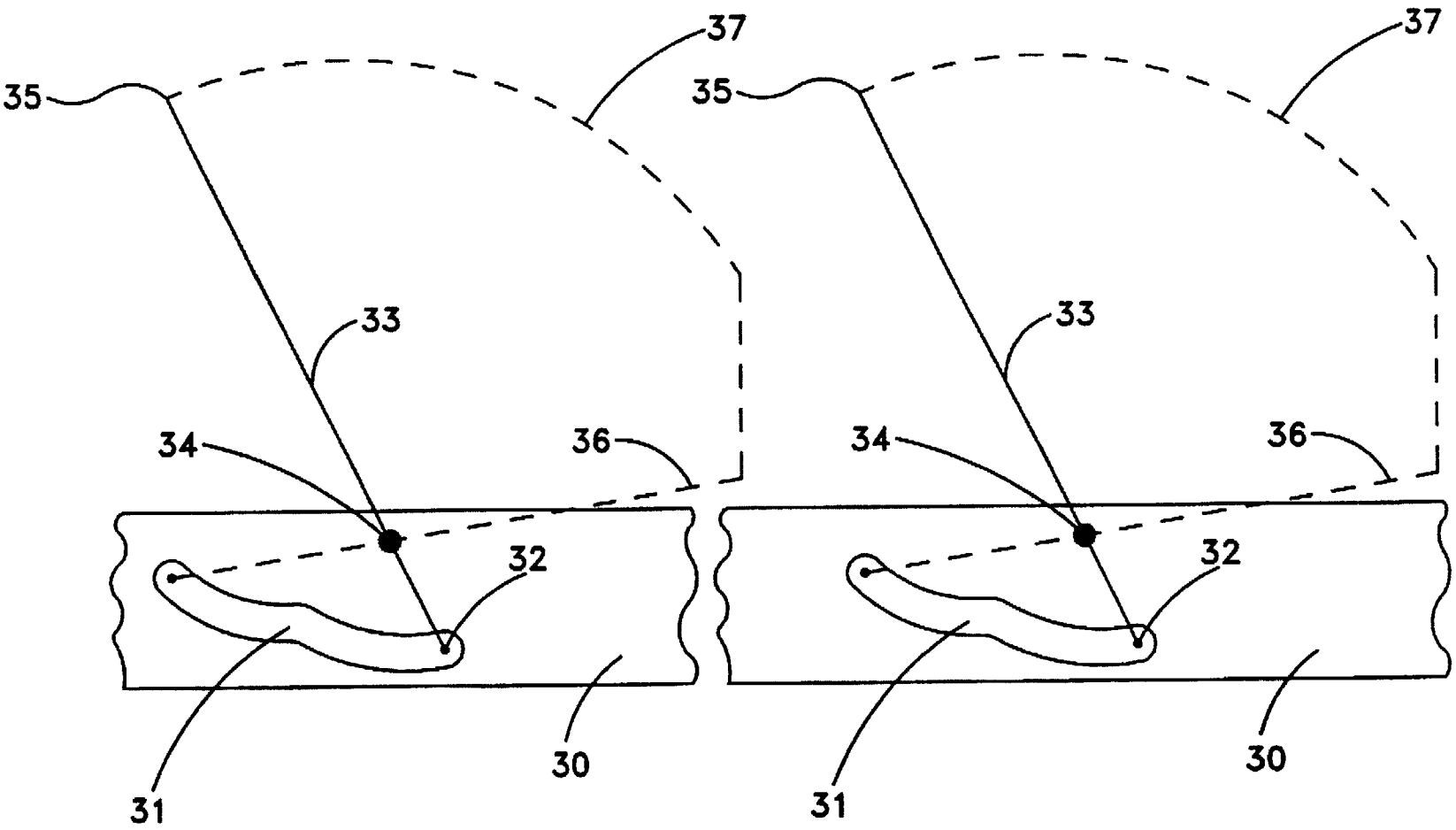
FIG. 4 is a further alternative embodiment of the invention.

A further alternative embodiment is shown in FIG. 4. More particularly, a fixed support bracket 30 includes two identical spaced apart guide slots 31 which receive respective first ends 32 of two hinged linkage arms 33. These arms are slidably and rotatably engaged to bracket 30 by a pin 34 and at their second ends 35 engage a movable support bracket (not shown). Arms 33 are sloted to effect the slidable and rotatable connection to pin 34.

Arms 33 move in unison between the configuration shown and the configuration designated by broken lines 36. When moving between these configurations ends 35 trace a path designated by broken lines 37 due to the interaction between arms 33, guide slots 31 and pins 34. In this particular embodiment the path traced by line 37 includes a combination of arcuate and linear paths. Alternative combinations are possible by varying the shape of slots 31.

Figure 5:
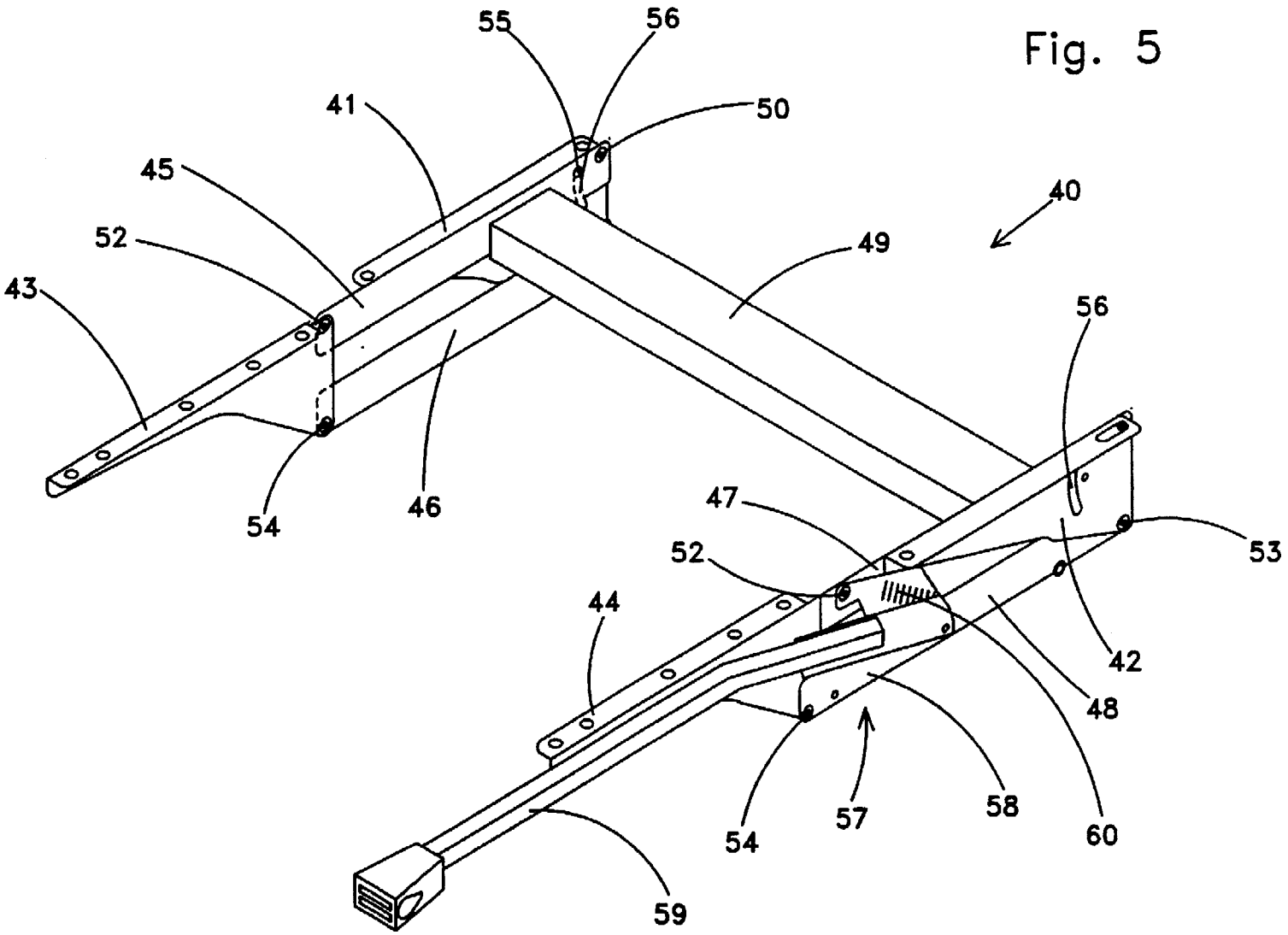
FIG. 5 is a perspective view of another alternative linkage system in accordance with the invention.
Figure 6:
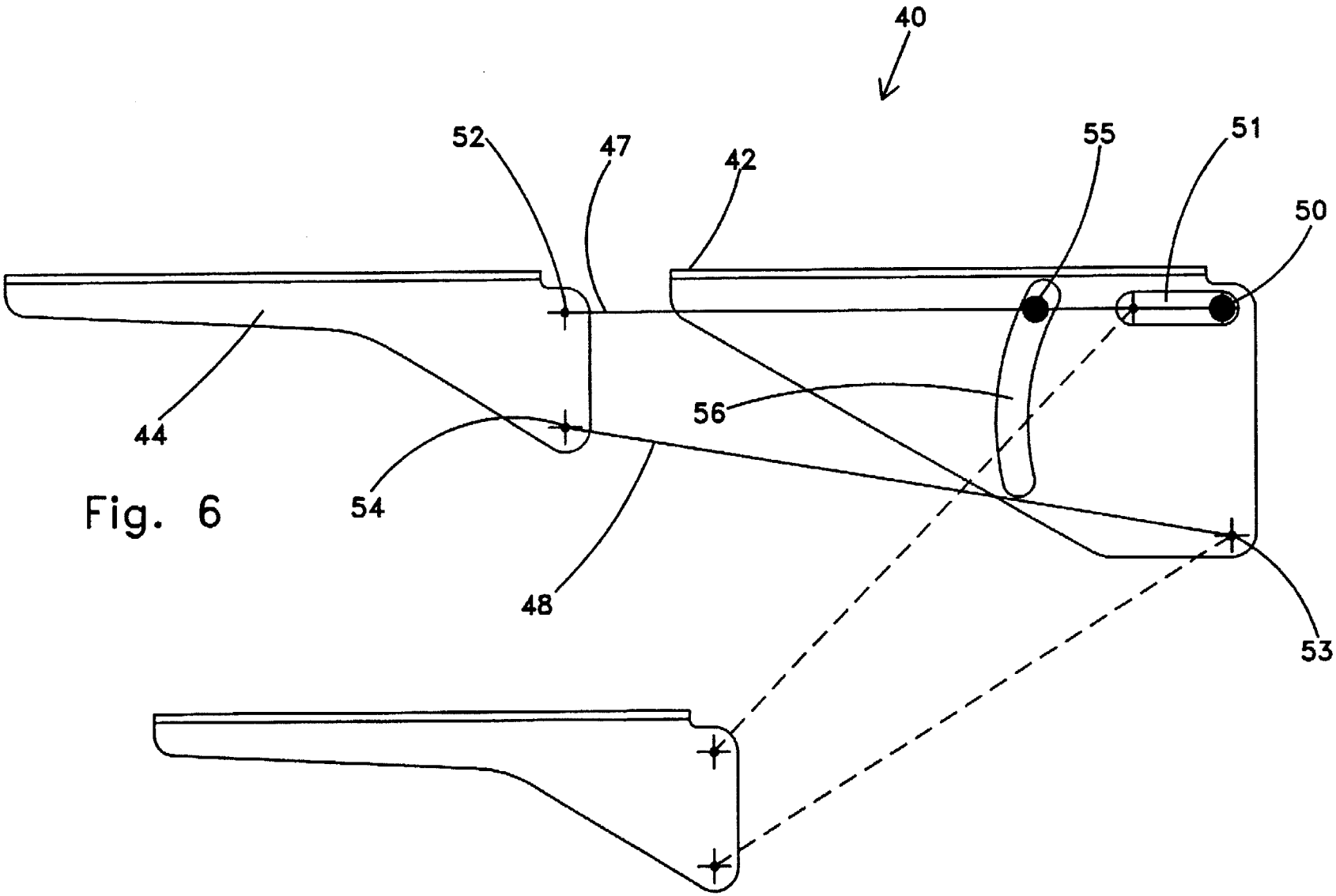
FIG. 6 is a schematic side view of the linkage system of FIG. 5.

Referring now to FIG. 5 and FIG. 6, there is illustrated a further embodiment of the invention. The linkage mechanism 40 illustrated includes a pair of opposed support brackets 41 and 42 which are adapted to be fixed to the underside of a desk surface by way of screws, rivets or the like. Brackets 41 and 42 are joined to respective adjacent keyboard support bracket 43 and 44 by way of linkage arms 45 and 46, and 47 and 48 respectively. Arms 45 and 47 are joined by a rectangular section cross member 49 to ensure simultaneous movement between these arms.

Arms 45 and 47 are rotatably and slidably connected to respective brackets 41 and 42 by pins 50 and slots 51 while being only rotatably connected to brackets 43 and 44 by pins 52. Arms 46 and 48, however, are rotatably connected to both brackets by way of pins 53 and 54. In addition, arms 45 and 47 include pins 55 which are captively retained within slots 56 in brackets 41 and 42.

As best shown in FIG. 5, linkage system 40 includes locking means 57 for selectively maintaining the brackets 43 and 44 at a relative height with respect to brackets 41 and 42. Locking means 57 comprises a biased plate 58 which is operable by handle 59 for moving slots 60 into and out of engagement with one or more locking protrusions (not shown) located on arm 48. Alternative locking arrangements are known.

Referring now in particular to FIG. 6, bracket 44 is able to progress between a raised and lowered configuration, as shown. During this progression, pins 50 and 55 respectively traverse slots 51 and 56 to provide a non-arcuate path for bracket 44.

The progression of bracket 44 involves both vertical and horizontal movement. The linkage system 40 continues to provide the same degree of vertical movement that was obtained from prior art pantographic mechanisms, while reducing the amount of horizontal movement. If required, and as illustrated by way of example in FIG. 3, slots 51 and 56 can be appropriately shaped to eliminate horizontal movement.

The vertical distance between pins 52 and 54 is approximately 60 mm, while the vertical separation between pins 50 and 53 is at least 70 mm. This non-pantographic arrangement provides an increase in strength of at least 30% over a standard pantographic mechanism having a spacing of 60 mm between the arms. Most advantageously, this increase in strength is achieved without increasing the depth of bracket 44 and thereby maintaining the original leg room provided under that bracket.

Figure 7:
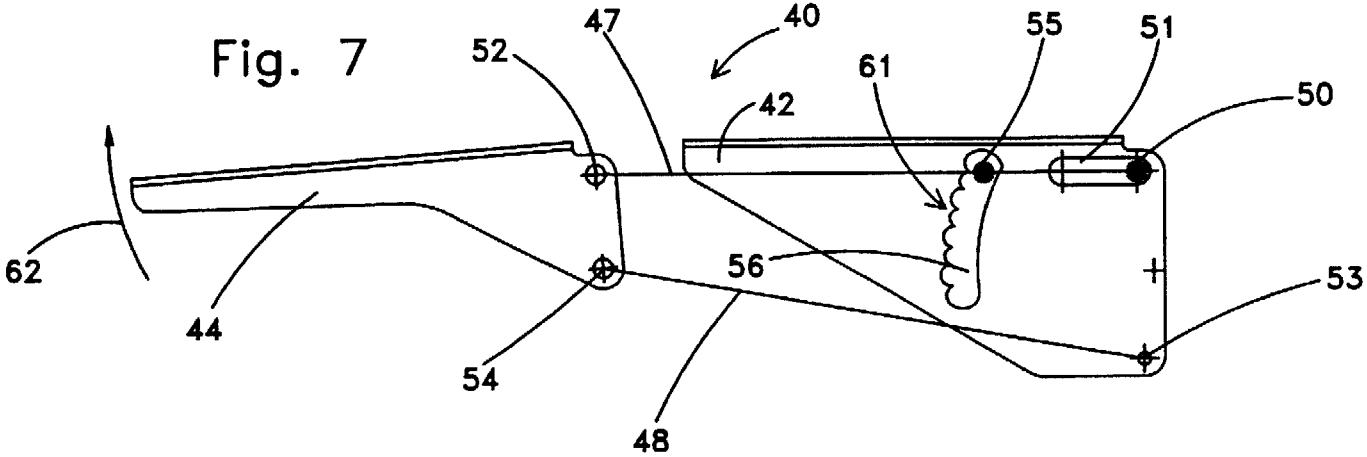
FIG. 7 is a schematic side view of the linkage system of FIG. 5 including alternative locking means.
Figure 8:
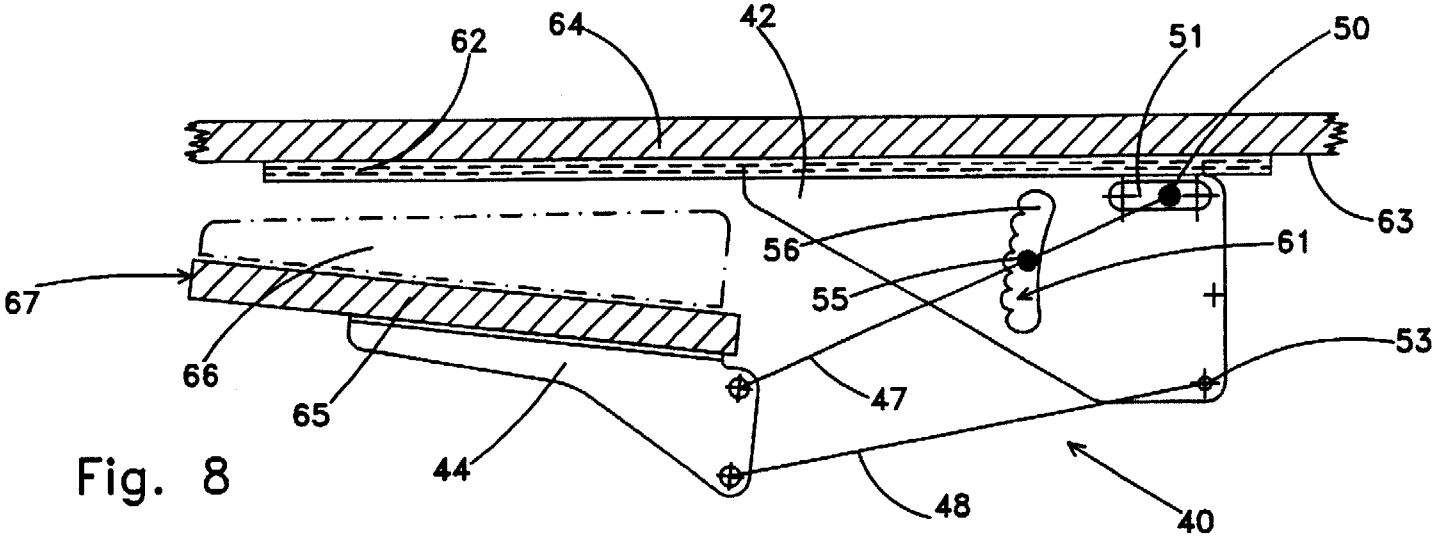
FIG. 8 is a schematic side view of the linkage system of FIG. 7 in use.

Referring to FIG. 7 and FIG. 8, where corresponding features are denoted with corresponding reference numerals, linkage system 40 includes alternative locking means. More particularly, slot 56 includes a plurality of alternating small and large semi-circular locking formations 61 for selectively captively retaining pin 55. Pin 55 is moved out of engagement with the formations 61 by applying an upward force in the direction of arrow 62 to overcome the gravitational bias provided by bracket 44. Thereafter, pin 55 can be progressed along slot 56, while pin 50 will simultaneously progress along slot 51. When the desired position has been achieved the force applied the bracket 44 is released and pin 55 will move into engagement with an adjacent formation 61.

The different sized interspaced locking formations 61 provide a degree of tilt adjustment for bracket 44. This is best shown in FIG. 8, where bracket 42 is slidably mounted within a track 62 which extends along the bottom surface 63 of a desk 64. Additionally, bracket 44 is secured to a keyboard support 65 which supports a keyboard 66. In the configuration shown, bracket 42 and 44 are nested beneath desk 64, and in addition, pin 55 is engaged with one of the smaller formations 61 to incline end 67 of keyboard support 65 toward surface 63. This provides a convenient mode for storage for keyboard 66 which can be retrieved, as required, by advancing bracket 42 along track 62 and subsequently adjusting the height of bracket 44, as described above.

Figure 9:
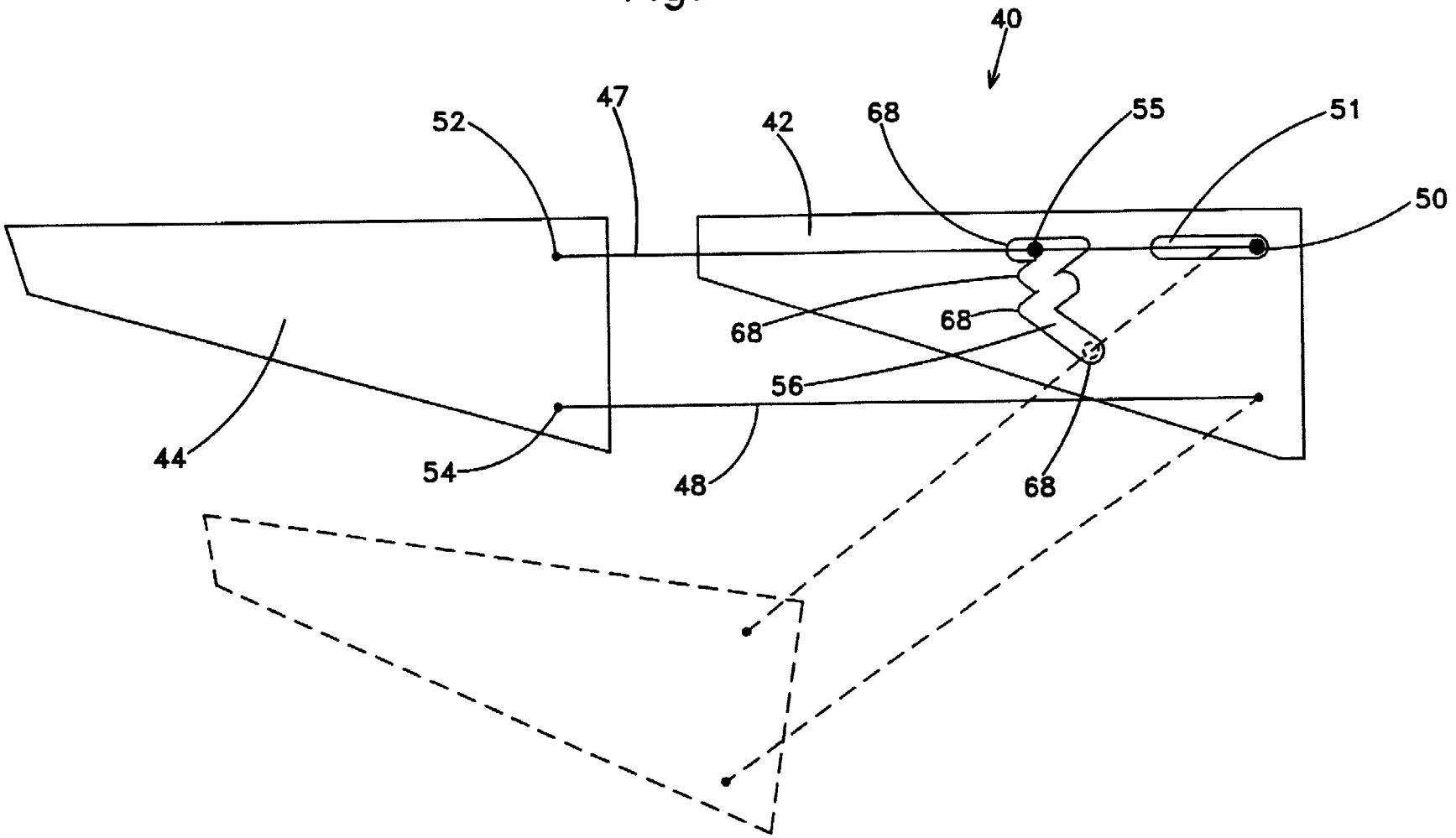
FIG. 9 is a schematic side view of an alternative linkage system according to the invention.

The embodiment of the invention illustrated in FIG. 9 is similar to that of FIGS. 7 and 8 and as such corresponding features will be denoted with corresponding reference numerals. However, slot 56 is a compound slot comprised of a series locking positions 68. Once pin 55 is in one of positions 68 it will remain so disposed until an upward force is provided on bracket 44 to overcome the locking bias. Advantage is again used of the interaction between slots 51 and 56 and pins 50 and 55 respectively to provide a simple and effective locking mechanism and a non-arcuate path between the raised and lowered configuration illustrated.

A further embodiment of the invention is shown in FIGS. 10 and 11 which are schematic side views of a linkage system 70. The linkage system includes a first bracket 71 having two spaced apart apertures 72 and 73 for receiving bolts, rivots or pins 74 and 75 for rotatably mounting arms 76 and 77 to the bracket. The arms include respective apertures 78 and 79 for receiving pins 74 and 75.

The distal ends of arms 76 and 77 are mounted to a movable bracket 80 for allowing movement of that bracket between a raised and lowered configuration, as best shown in FIG. 11. More particularly, arm 76 includes at its distal end an aperture 81 and a slot 82 spaced from that aperture. Arm 77, however, includes at its distal end a single aperture 83.

In use, a pin 84 passes through aperture 85 in bracket 80, aperture 83 in arm 77 and slot 82 in arm 76. A further pin 86 passes through slot 87 in bracket 80 and aperture 81 in arm 76. During progression of bracket 80 between the raised and lowered configurations shown in FIG. 8 pins 84 and 86 progress along slots 82 and 87 respectively.

The substantially linear, non-arcuate progression of bracket 80 is particularly advantageous for height adjustable desk linkage systems.

A locking mechanism can be incorporated with linkage system 70 to selectively maintain bracket 80 at a predetermined disposition with respect to bracket 71. For example, one of slots 82 or 87 can include locking formations for receiving respective pins 84 and 82. Alternative arrangements would be apparent to those skilled in the art.

It will be appreciated that many different known locking mechanisms suitable for use with one or more of the embodiments described above.

Although the invention has been described with reference to specific examples, it will be appreciated by those skilled in the art that the invention may be embodied in many other forms. For example, the control and guide formations can provide a degree of flexibility for a linkage arm suitable for robotics and related applications.

I claim:

1. A linkage system comprising:

a first element defining a guide slot and a control slot;

a second element;

a linkage arm respectively connected at a first end and a second end to the first and second elements, the linkage arm including at the first end a first hinge pin for slidably inter-engaging the guide slot and spaced apart from said first hinge pin, a second hinge pin for slidably inter-engaging the control slot, whereby relative movement between the hinge pins and the guide slot and the control slot respectively provides for predetermined non-arcuate relative movement between the first and second elements; and locking formations for selectively engaging one of the hinge pins for maintaining the first and second elements in one of a number of relative positions, said locking formations extending into at least one of the control slot and the guide slot.

2. A linkage system according to claim 1 wherein one of the first and second elements comprises a fixed support bracket for attachment to a desk surface and the other one of the first and second elements comprises a keyboard support bracket for attachment to a keyboard support, whereby, in use, the keyboard support is movable between a raised configuration and a lowered configuration with respect to the desk surface.

3. A linkage system according to claim 1 further comprising a second linkage arm extending between the first and second elements.

4. A linkage system according to claim 3 wherein the second linkage arm is rotatably connected at respective ends to the first and second elements.

5. A linkage system according to claim 3 wherein the second linkage arm is hingedly and slidably connected at an end to one of the first and second elements.

6. A linkage system according to claim 5 wherein the linkage arm and the second linkage arm are spaced apart at one of the first and second elements.

7. A linkage system according to claim 5 wherein the linkage arm and the second linkage arm are spaced apart at the first element and at the second element, the spacing between the linkage arm and the second linkage arm being greater at the first element than at the second element.

8. A linkage system according to claim 1 wherein said hinge pins are fixedly spaced apart.

9. A keyboard support apparatus comprising:

a first element having a guide formation and a control formation;

a second element;

a linkage arm respectively connected at a first end and a second end to the first and second elements, the linkage arm including at the first end a first engagement formation for slidably interengaging the guide formation and spaced apart from said first engagement formation, a second engagement formation for slidably engaging the control formation, whereby relative movement between the engagement formations and the guide formation and the control formation respectively provides for predetermined non-arcuate relative movement between the first and second elements; and wherein one of the first and second elements comprises a support bracket for attachment to a desk surface, and the other one of the first and second elements comprises a keyboard support bracket for attachment to a keyboard support, whereby, in use, the keyboard support is movable between a raised configuration and a lowered configuration with respect to the desk surface.

10. A keyboard support apparatus according to claim 9 wherein the engagement formations are comprised of hinge pins; and wherein the guide formation is comprised of a guide slot formed in the first element, and the control formation is comprised of a control slot formed in the first element, the guide slot and the control slot being adapted to receive the hinge pins.

11. A keyboard support apparatus according to claim 10 further comprising locking formations for selectively engaging one of the hinge pins so as to maintain the fixed support bracket and the keyboard support bracket in one of a number of relative dispositions, said locking formations extending into at least one of the guide slot and the control slot.

12. A keyboard support apparatus according to claim 9 further comprising a second linkage arm extending between the fixed support bracket and the keyboard support bracket.

13. A keyboard support apparatus according to claim 12 wherein the second linkage arm is rotatably connected at respective ends to the fixed support bracket and the keyboard support bracket.

14. A keyboard support apparatus according to claim 12 wherein the second linkage arm is hingedly and slidably connected at an end to one of the fixed support bracket and the keyboard support bracket.

15. A keyboard support apparatus according to claim 14 wherein the linkage arm and the second linkage arm are spaced apart at one of the fixed support bracket and the keyboard support bracket.

16. A keyboard support apparatus according to claim 15 wherein the linkage arm and the second linkage arm are spaced apart at the fixed support bracket and at the keyboard support bracket, the spacing between the linkage arm and the second linkage arm being greater at the fixed support bracket than at the keyboard support bracket.

17. A keyboard support bracket according to claim 9 wherein said engagement formations are fixedly spaced apart.

* * * * *